US005192073A

United States Patent [19]

Iwanaga et al.

[11] Patent Number: 5,192,073

[45] Date of Patent: Mar. 9, 1993

[54] GOLF CLUB SET

[75] Inventors: Takeshi Iwanaga, Kobe; Hideaki Kawamatsu, Takarazuka, both of Japan

[73] Assignee: Sumitomo Rubber Industries, Ltd., Kobe, Japan

[21] Appl. No.: 668,123

[22] Filed: Mar. 12, 1991

[30] Foreign Application Priority Data

Mar. 20, 1990 [JP] Japan ..... 2-70828

[51] Int. Cl.[5] ..... A63B 53/00

[52] U.S. Cl. ..... 273/77 A; 273/80 B; 273/80.9

[58] Field of Search ..... 273/77 A, 80 B, 80.6, 273/80.9

[56] References Cited

U.S. PATENT DOCUMENTS 2,250,428 7/1941 Vickery ..... 273/80 B
2,822,174 2/1958 Brandon ..... 273/77 A
3,871,649 3/1975 Kilshaw ..... 273/77 A
3,963,236 6/1976 Mann .
4,240,631 12/1980 MacDougall .
4,555,112 11/1985 Masghati ..... 273/77 A
4,563,007 1/1986 Bayliss et al. ..... 273/77 A
4,725,060 2/1988 Iwanaga .

FOREIGN PATENT DOCUMENTS 2090536 7/1982 United Kingdom .
2227418 8/1990 United Kingdom ..... 273/77 A

*Primary Examiner*—V. Millin
*Assistant Examiner*—William M. Pierce
*Attorney, Agent, or Firm*—William H. Eilberg

[57] ABSTRACT

The present invention provides a golf club set comprising differently numbered wood clubs and differently numbered iron clubs. The shaft of each club have reverse deflection which is defined as displacement of a standard shaft point when a predetermined load is applied to the shaft a predetermined distance from the shaft head end with the head end fixed. The reverse deflection of the wood club shafts decreases proportionally as the wood club number increases. The reverse deflection of the iron club shafts decreases progressively as the iron club number increases, and further retains proportionality relative to the proportionally decreasing reverse deflection of the wood club shafts.

9 Claims, 4 Drawing Sheets

GOLF CLUB SET

BACKGROUND OF THE INVENTION

1. Field of the Invention

This invention relates to a set of golf clubs. More particularly, the invention relates to a golf club set which comprises a plurality of differently numbered wood clubs and a plurality of differently numbered iron clubs.

2. Description of the Prior Art

As is well known, various types of golf clubs are commercially available which include wood clubs, iron clubs, putters, and so on. The wood clubs comprise No. 1 to No. 5 woods, while the iron clubs include No. 1 to No. 9 irons. The golfer brings all or selected ones of these clubs, and in play selects an optimum club for making a shot which he or she wants in a particular situation.

Golf clubs are often sold in a set although it is also possible to purchase any golf clubs separately at the golfer's option. Usually, such a golf club set includes No. 1 wood (driver), No. 3 wood (spoon), No. 4 wood (baffy), No. 3 to No. 9 irons, a pitching wedge, a sand wedge, and a putter. The golf club set may additionally include No. 5 wood (cleek) and No. 2 iron.

In general, average golfers often find difficulty in using long irons (usually No. 1 to No. 4 irons) because these irons are liable to erroneous shots. Such erroneous shots are partly due to the fact that the long iron is rather small in loft angle, sole thickness, head inertial moment and sweet spot area.

Another cause for difficulty in using the long iron resides in that it is relatively inflexible near the head end in comparison with the wood club. To more clearly explain this point, reference is now made to FIG. 8 illustrating the reverse deflection characteristics of the golf clubs included in a typical prior art golf club set.

In the graph shown in FIG. 8, the ordinate represents the reverse deflection (mm) of the club shafts included in the prior art golf club set, whereas the abscissa indicates the club number for both of the wood clubs and the iron clubs. The "reverse deflection" used herein is a parameter which indicates the head-end side flexibility of each club shaft and which is defined as displacement of a standard shaft point when a predetermined load is applied to the shaft at a predetermined distance from the head end of the shaft with the head end fixed. A specific method for measuring the reverse deflection will be described later in connection with the preferred embodiments of the present invention.

As clearly seen in FIG. 8, the reverse deflection of the wood clubs decreases proportionally along line X as the wood club number increases, and the reverse deflection of the iron clubs also decreases proportionally along line Y as the iron club number increases. However, the line X for the woods is much steeper in inclination than the line Y for the irons, so that there is no proportionality between the lines X and Y. Further, there is an abrupt decrease in reverse deflection from the No. 5 wood (the highest numbered or shortest wood in the set) to the No. 3 iron (the lowest numbered or longest iron in the set).

It is concluded from FIG. 8 that the reverse deflection of the long irons (the No. 3 and No. 4 irons) included in the prior art set is abruptly smaller than that of the wood clubs. In other words, the long iron club shafts of the prior art set are abruptly harder than the wood club shafts. Thus, when changing from a wood club to a long iron, the golfer will have a strange feel that the long iron is excessively hard in comparison with the wood club.

Basically, a long iron is used to make a relatively long shot, and therefore required to have shaft property (e.g. reasonable flexibility at the head-end side) generally similar to that of a wood club. In spite of such a requirement, the long iron of the prior art golf club set differs drastically in shaft property from the wood club. Due to this drastic difference, the golfer feels it difficult to use the long iron. Further, the head-end side of a club shaft must flex sufficiently to hit the ball high for an increased carry. However, the long iron shaft of the prior art set is excessively hard at the head-end side, so that it is difficult for an average golfer to realize a long carry with the prior art long iron.

SUMMARY OF THE INVENTION

It is, therefore, an object of the present invention to provide a golf club set including wood clubs and iron clubs, wherein the iron clubs are suitably adjusted in head-end side flexibility to eliminate or reduce a strange feel when the golfer changes from a wood club to a long iron club, and wherein the long iron club enables the golfer to hit the ball higher for an increased carry than a corresponding iron included in the conventional golf club set.

For this object, the invention provides a golf club set comprising a plurality of differently numbered wood clubs and a plurality of differently numbered iron clubs, each club including a shaft having reverse deflection which is defined as displacement of a standard shaft point when a predetermined load is applied to the shaft at a predetermined distance from a head end of the shaft with the head end fixed, the reverse deflection of the wood club shafts decreasing substantially proportionally as the wood club number increases, the reverse deflection of the iron club shafts decreasing as the iron club number increases, wherein: the shafts of at least selected iron clubs including a lowest numbered iron club have reverse deflection which retains general proportionality relative to the proportionally decreasing reverse deflection of the wood club shafts.

Other objects, features and advantages of the invention will be fully understood from the following detailed description given with reference to the accompanying drawings.

DETAILED DESCRIPTION OF THE PREFERRED EMBODIMENTS

Figure 1:
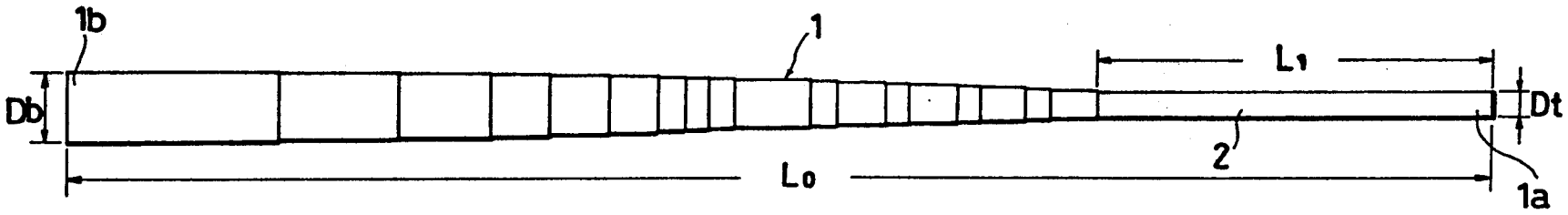
FIG. 1 is a view showing a multiply stepped club shaft to which the present invention is applicable.

FIG. 1 shows a multiply stepped shaft 1 to which a first embodiment of the present invention may be applied. Specifically, the shaft 1 is made of stainless steel or any other suitable metal, and formed to have different steps which progressively increase in diameter from a head end 1*a* to a grip end 1*b*. Thus, the shaft is diametrically smallest at the head end 1*a*, and diametrically largest at the grip end 1*b*. However, the shaft diameter within each single step is constant.

In FIG. 1, the smallest diameter of the shaft 1, which is called "tip diameter", is represented by reference sign Dt, whereas the largest diameter of the shaft, which is termed "butt diameter", is designated by reference sign Db. Further, the length of the diametrically smallest or first step 2 is represented by reference sign $L_1$, whereas the overall length of the shaft 1 is denoted by reference sign $L_0$.

Table 1 below compares a golf club set according to the first embodiment of the invention (hereafter "first inventive set") with a conventional golf club set, each set including differently numbered wood clubs (No. 1 wood and No. 3 to No. 5 woods) and differently numbered iron clubs (No. 3 to No. 9 irons). Each set also includes a pitching wedge and a sand wedge. In either of the two golf club sets, all of the club shafts are multiply stepped, as shown in FIG. 1. Further, each step of each club shaft included in the first inventive set is equal in diameter to a corresponding step of a corresponding club shaft included in the conventional set.

TABLE 1

| Club No. | $L_1$ (mm) Invention | $L_1$ (mm) Conventional | $L_0$ (mm) Invention & Conventional |
|---|---|---|---|
| W #1 | 312.0 | 312.0 | 1092.2 |
| W #3 | 286.6 | 286.6 | 1066.8 |
| W #4 | 273.9 | 273.9 | 1054.1 |
| W #5 | 261.2 | 261.2 | 1041.4 |
| I #3 | 365.0 | 295.0 | 977.9 |
| I #4 | 342.3 | 282.3 | 965.2 |
| I #5 | 319.6 | 269.6 | 952.5 |
| I #6 | 296.9 | 256.9 | 939.8 |
| I #7 | 274.2 | 244.2 | 927.1 |
| I #8 | 251.5 | 231.5 | 914.4 |
| I #9 | 228.8 | 218.8 | 901.7 |
| P/S | 206.1 | 206.1 | 889.0 |

Notes:
(1) P/S represents "pitching wedge" and "sand wedge" respectively.
(2) The butt diameter Db for all clubs is 15.2 mm.
(3) The tip diameter Dt for all wood clubs is 8.5 mm, whereas that for all iron club shafts is 9.4 mm.

As understood from Table 1, the respective clubs of the first inventive set are equal in overall shaft length $L_0$ to the corresponding clubs of the conventional set. Further, the respective wood clubs of the first inventive set are equivalent in first step length $L_1$ to the corresponding wood clubs of the conventional set. Thus, the first inventive set is not different from the conventional set in these respects.

On the other hand, the first step length $L_1$ of each iron club of the first inventive set is larger than that of a corresponding iron club of the conventional set. The pitching wedge and the sand wedge are equivalent in first step length $L_1$ to those of the conventional set. The respective iron clubs, including the pitching and sand wedges, of the first inventive set are now compared specifically with those of the conventional set.

In both of the first inventive and conventional sets, the overall length $L_0$ of the respective iron clubs decreases gently by a constant decremental amount $\Delta L_0$ of 12.7 mm as the iron club number increases by one. For example, the overall length of the No. 3 iron is 977.9 mm, whereas that of the No. 4 iron is 965.2 mm which is smaller by 12.7 mm than 977.9 mm for the No. 3 iron. Similarly, the overall length of the No. 5 iron is 952.5 mm which is smaller by 12.7 mm than 965.2 mm for the No. 4 iron.

In the conventional set, the first step length $L_1$ of the respective iron clubs also decreases gently by a constant decremental amount $\Delta L_1$ of 12.7 mm as the iron club number increases by one. For instance, the first step length of the No. 3 iron is 295.0 mm, whereas that of the No. 4 iron is 282.3 mm which is smaller by 12.7 mm than 295.0 mm for the No. 3 iron. Likewise, the first step length of the No. 5 iron club is 269.6 mm which is less by 12.7 mm than 282.3 mm for the No. 4 iron. Thus, in the conventional set, $\Delta L_1 = \Delta L_0 = 12.7$ mm.

In the first inventive set, on the other hand, the first step length $L_1$ of the respective iron clubs decreases more sharply by a constant decremental amount $\Delta L_1$ of 22.7 mm as the iron club number increases by one. For example, the first step length of the No. 3 iron is 365.0 mm, while that of the No. 4 iron is 342.3 mm which is less by 22.7 mm than 365.0 mm for the No. 3 iron. Similarly, the first step length of the No. 5 iron is 319.6 mm which is smaller by 22.7 mm than 342.3 mm for the No. 4 iron. Thus, in the first inventive set, the following inequality is applicable.

$$\Delta L_1 = 22.7 \text{ mm} > \Delta L_0 = 12.7 \text{ mm}$$

It is further appreciated from Table 1 that the first step length $L_1$ of each iron club of the first inventive set is larger by $(\Delta L_1 - \Delta L_0) \times n$ (mm) than that of a corresponding iron club of the conventional set, where n is selected in the following manner.

$$I\#3: n = 7,\ I\#4: n = 6,\ I\#5: n = 5,\ I\#6: n = 4$$

$$I\#7: n = 3,\ I\#8: n = 2,\ I\#9: n = 1,\ P/S: n = 0$$

According to Table 1, $\Delta L_1 - \Delta L_0 = 22.7 - 12.7 = 10$ mm. Thus, the first step length $L_1$ of the No. 3–No. 9 irons of the first inventive set is larger by 70 mm, 60 mm, 50 mm, 40 mm, 30 mm, 20 mm and 10 mm, respectively, than that of the correspondingly numbered irons of the conventional set. The first step length of the pitching and sand wedges of the first inventive set is equal to that of the corresponding clubs of the conventional set.

According to the invention, the first step length $L_1$ of the No. 3 iron should be preferably 35–40% of the overall length $L_0$ of the same iron. In the first inventive set shown in Table 1, the first step length of the No. 3 iron is 365.0 mm which corresponds to about 37% of the overall length (977.9 mm) of the same iron.

Figure 7:
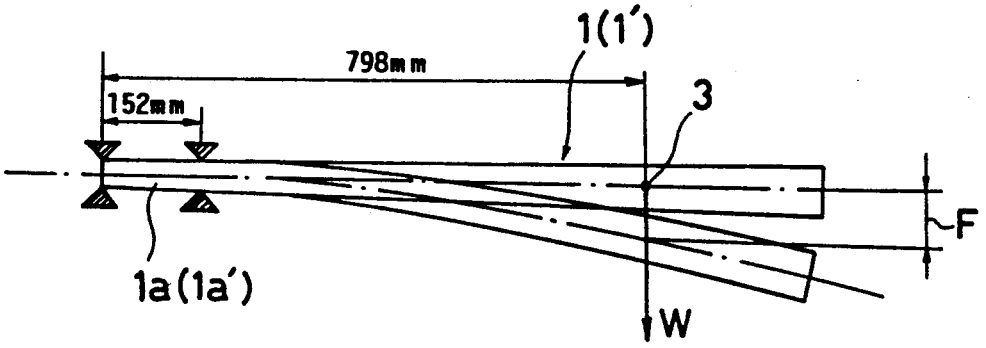
FIG. 7 is a view illustrating the method for measuring the reverse deflection of a club shaft.

FIG. 7 shows a method for measuring the head-end side flexibility (reverse flexibility) of each golf club shaft. As illustrated, the shaft 1 is supported in a cantilever fashion with the head end 1*a* fixed, and a predetermined load W is applied to the shaft at a load applying point 3 to measure displacement (reverse deflection) F of a standard shaft point. The term "reverse deflection" is used to indicate the contrast against the normal deflection which is obtained by measurement wherein the shaft is supported with its grip end fixed.

According to the method shown in FIG. 7, the fixing length for the shaft 1 is 152 mm, whereas the load applying point 3 is located at a distance of 798 mm from the head end 1*a* and coincides with the standard shaft point used for deflection measurement. Further, the applied load is 1.3 kg.

Figure 2:
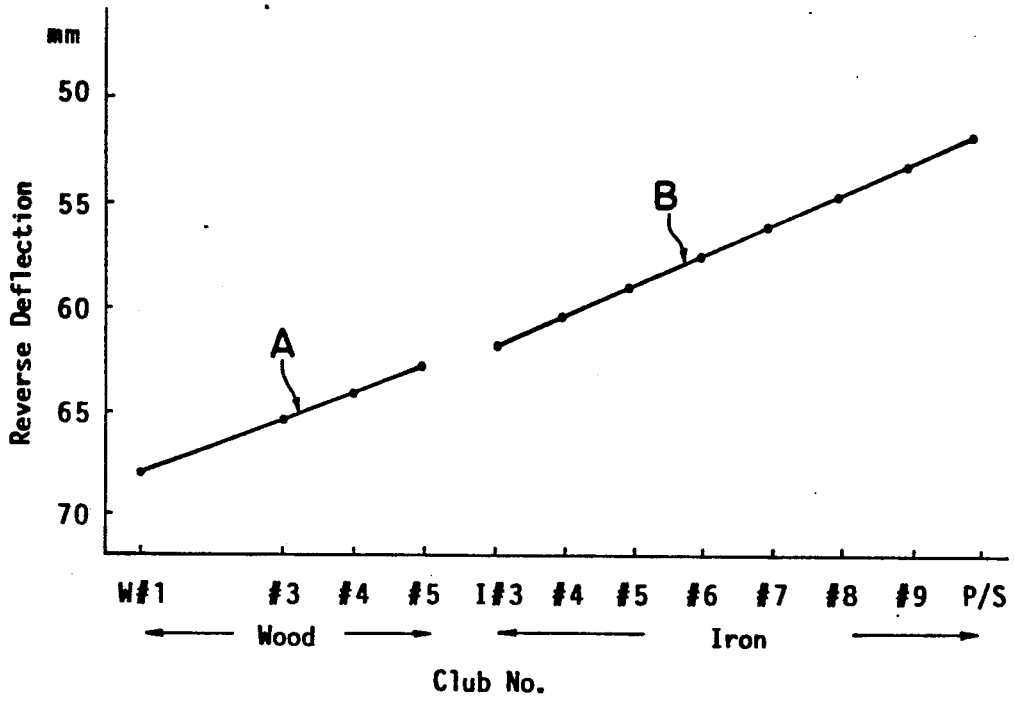
FIG. 2 is a graph showing the reverse deflection characteristics of a golf club set according to the invention.
Figure 8:
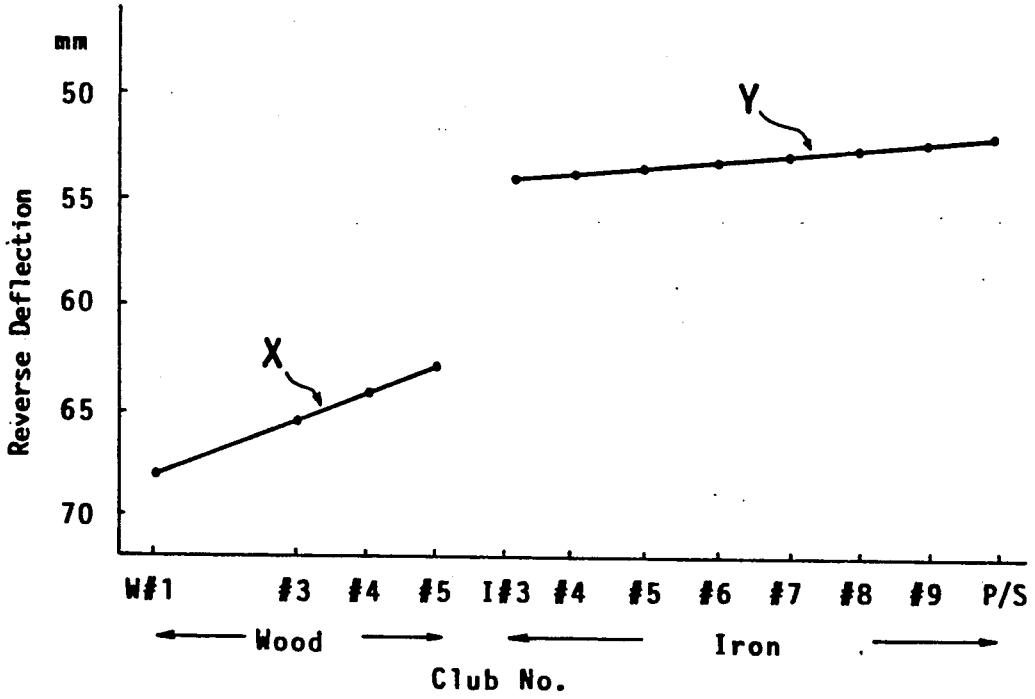
Fig. 8 Prior Art
FIG. 8 is a graph showing the reverse deflection characteristics of a prior art golf club set.

FIG. 2 shows how the respective clubs of the first inventive (Table 1) set vary in reverse deflection F. On the other hand, FIG. 8 illustrates how the respective clubs of the conventional set alter in reverse deflection, as already described. Specifically, in FIG. 2, line A represents reverse deflection variation for the wood clubs of the inventive set, while line B indicates reverse deflection variation for the iron clubs, including the pitching and sand wedges, of the inventive set.

It is appreciated from FIG. 2 that the reverse deflection F of the respective wood clubs of the first inventive set decreases proportionally as the wood club number increases. Similarly, the reverse deflection of the respective iron clubs also decreases proportionally as the iron club number increases.

In the first inventive set, more importantly, the line B for the iron clubs is arranged substantially on an extension of the line A for the wood clubs. In other words, the reverse deflection F of the respective iron clubs retains proportionality relative to that of the respective wood clubs. Thus, there is no abrupt difference in reverse deflection between the woods and the long irons (No. 3 and No. 4 irons), so that the golfer will not experience a strange feel when changing from a wood club to a long iron club.

By contrast, in the conventional set, there is an abrupt decrease in reverse deflection F when shifting from the woods to the long irons, as already described. Thus, the golfer will have a strange feel when changing from a wood club to a long iron club.

The first step length $L_1$ of the long irons included in the first inventive set is much larger than that of the corresponding irons included in the conventional set, as clearly shown in Table 1. Thus, in comparison with the conventional long irons, the long irons of the first inventive set provide a softer feel at the time of striking the ball, thereby reducing the shocks to the golfer's hands. Further, the long irons of the first inventive set provide a lower kick point (flex point) than those of the conventional set, consequently increasing the initial trajectory angle of the hit ball to result in an increased carry.

The first embodiment described above is applicable only to a set of golf clubs each which has a multiply stepped shaft because that embodiment relies on adjustment of the first step length $L_1$ for reverse deflection adjustment. However, the reverse deflection F of any club shaft can be also adjusted by varying the tip diameter Dt of the shaft, so that the present invention may be embodied by utilizing this manner of reverse deflection adjustment.

Figure 3:
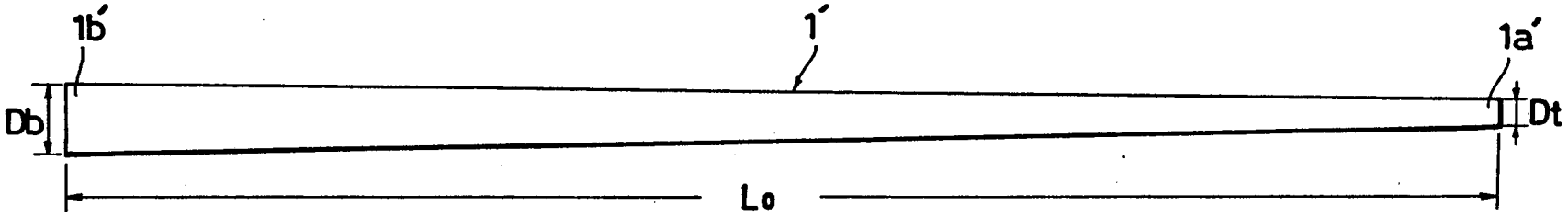
FIG. 3 is a view showing a non-stepped club shaft to which the present invention is also applicable.

FIG. 3 shows a non-stepped club shaft 1′ to which a second embodiment of the present invention may be applied. Specifically, the non-stepped shaft is continuously tapered so that the shaft diameter increases progressively from a head end 1*a*′ to a grip end 1*b*′. The non-stepped shaft is usually made of graphite or fiber-reinforced resin, but may also be made of a metal. In general, it is difficult to make a stepped shaft from graphite or fiber-reinforced resin.

Table 2 below compares a golf club set according to the second embodiment of the present invention (hereafter "second inventive set") with another conventional golf club set, each set including differently numbered wood clubs (No. 1 wood and No. 3 to No. 5 woods) and differently numbered iron clubs (No. 3 to No. 9 irons). Each set further includes a pitching wedge and a sand wedge. In either of the two golf club sets, all of the club shafts are made of graphite and continuously tapered, as shown in FIG. 3.

TABLE 2

| Club No. | Dt (mm) Invention | Dt (mm) Conventional |
|---|---|---|
| W #1 | 8.50 | 8.50 |
| W #3 | 8.50 | 8.50 |
| W #4 | 8.50 | 8.50 |
| W #5 | 8.50 | 8.50 |
| I #3 | 8.50 | 9.00 |
| I #4 | 8.57 | 9.00 |
| I #5 | 8.63 | 9.00 |
| I #6 | 8.70 | 9.00 |
| I #7 | 8.77 | 9.00 |
| I #8 | 8.83 | 9.00 |
| I #9 | 8.90 | 9.00 |
| P/S | 9.00 | 9.00 |

Notes:
(1) P/S represents "pitching wedge" and "sand wedge" respectively.
(2) The butt diameter Db for all clubs is 15.2 mm.
(3) The respective club shafts correspond in overall length $L_0$ to those shown in Table 1.

As clearly understood from Table 2, all of the wood clubs included in both of the second inventive and conventional sets have an equal tip diameter Dt of 8.50 mm. Further, the respective iron clubs of the conventional set have an equal tip diameter Dt of 9.00 mm.

By contrast, the respective iron clubs of the second inventive set progressively increase in tip diameter Dt as the iron club number increases. Thus, the No. 3 iron, which is the lowest numbered iron (longest iron) of the second inventive set, has a smallest tip diameter of 8.50 mm, and any higher numbered iron has a larger tip diameter than any lower numbered iron. The pitching wedge P and the sand wedge S have a largest tip diameter of 9.00 mm which is equal to the tip diameter of each iron club of the conventional set.

Preferably, the tip diameter Dt of the lowest numbered iron club should be exactly or nearly equal to that of the wood clubs within a deviation range of 0 mm to +0.2 mm. In the second inventive set shown in Table 2, the tip diameter of the lowest numbered iron, i.e., the No. 3 iron, is 8.5 mm which is exactly equal to that of the wood clubs.

Figure 4:
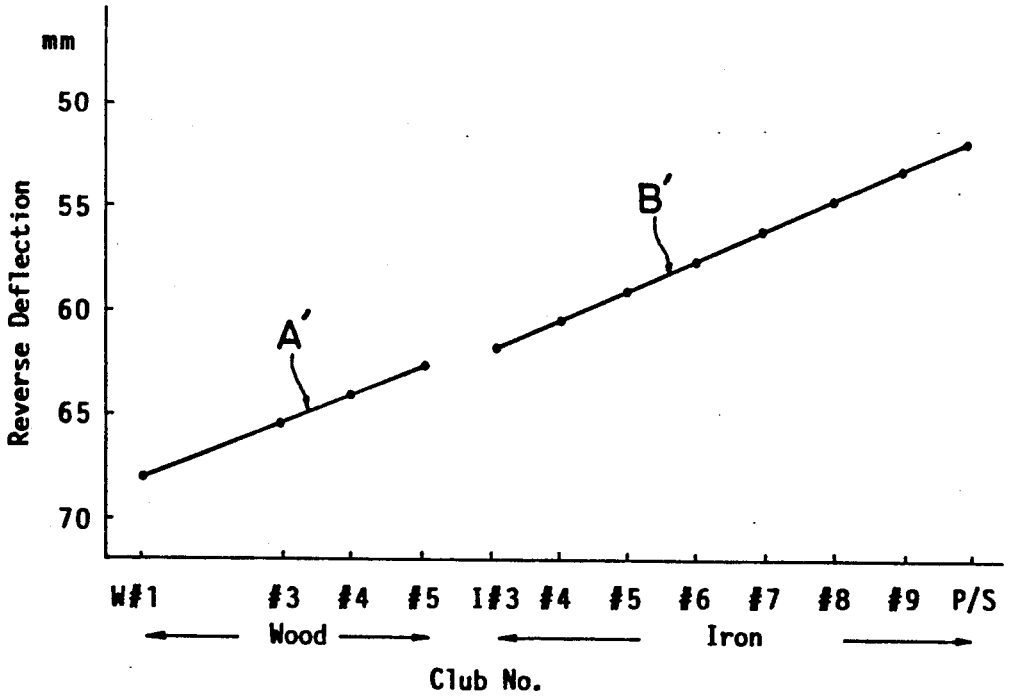
FIG. 4 is a graph showing the reverse deflection characteristics of another golf club set according to the present invention.

FIG. 4 shows how the respective clubs (shafts) of the second inventive set varies in reverse deflection F (determined by the method shown in FIG. 7). In FIG. 4, line A′ represents reverse deflection variation for the respective wood clubs, whereas line B′ indicates reverse deflection variation for the respective iron clubs. On the other hand, the respective clubs included in the conventional set of Table 2 exhibit reverse deflection variation which is similar to that shown in FIG. 8. As clearly appreciated, the lines A′ and B′ in FIG. 4 correspond respectively to the lines A and B in FIG. 2. Thus, the long irons (low numbered irons) of the second inventive set exhibit reasonable reverse flexibility relative to the wood clubs, so that the second inventive set has the same advantages as the first inventive set.

In nature, tip diameter adjustment is applicable not only to non-stepped club shafts but also to stepped club shafts. Thus, the inventive idea shown in Table 2 may be applied to a set of golf clubs each having a stepped shaft (see FIG. 1).

Further, for a set of golf clubs each having a multiply stepped shaft (FIG. 1), the two inventive ideas shown respectively in Tables 1 and 2 may be combined to obtain substantially the same reverse flexibility characteristics as illustrated in FIG. 2 or 4. In such a modification, the first step length $L_1$ of the respective iron clubs included in the set decreases progressively by an amount $\Delta L_1$ (larger than $\Delta L_0$) as the iron club number increases by one, whereas the tip diameter Dt of the respective iron clubs increases progressively as the iron club number increases by one. However, the decremental amount $\Delta L_1$ of the first step length $L_1$ and the incremental amount of the tip diameter Dt for the irons of the modified set should be smaller than those for the first and second inventive sets respectively.

Figure 5:
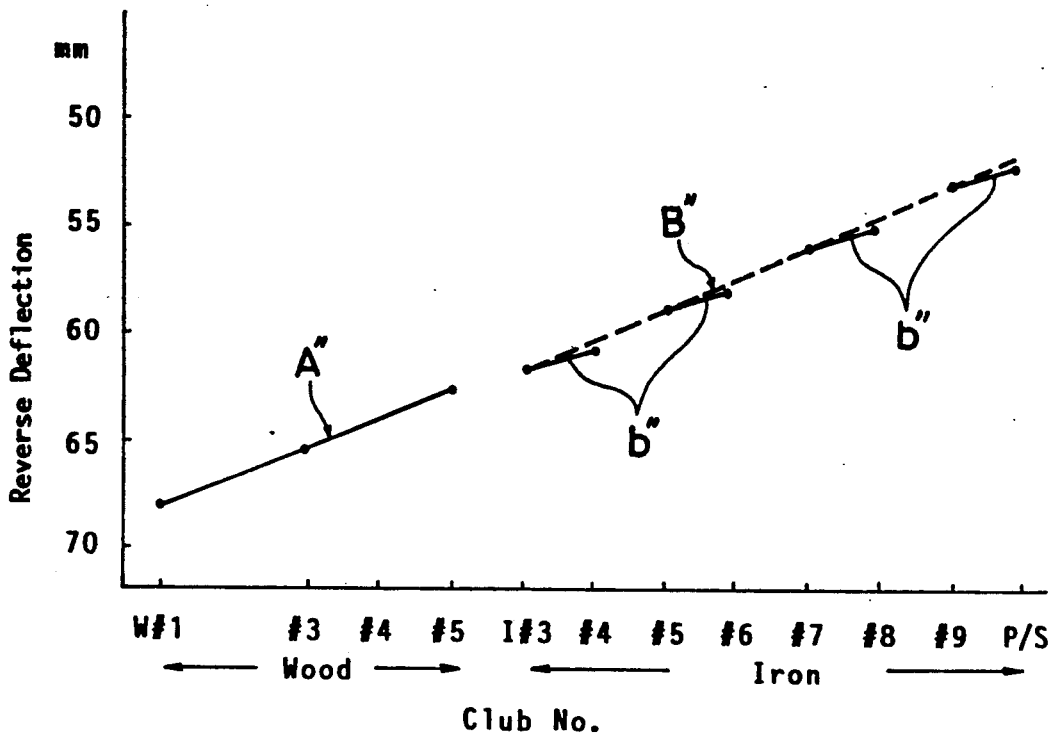
FIG. 5 is a graph showing the reverse deflection characteristics of a further golf club set according to the present invention.

FIG. 5 shows another modification which is also applicable to a set of golf clubs each having a multiply stepped shaft (FIG. 1). In the modification of FIG. 5, the first step length $L_1$ of the respective iron clubs included in the set is made to decrease progressively by an amount $\Delta L_1$ (larger than $\Delta L_0$) as the iron club number increases by one, whereas the tip diameter Dt of the iron clubs is made to increase progressively as the iron club number increases by two. Specifically, the No. 3 and No. 4 irons have an equal tip diameter Dt, and the No. 5 and No. 6 irons also have an equal tip diameter which is larger than that of the No. 3 and No. 4 irons. Similarly, the No. 7 and No. 8 irons have an equal tip diameter which is larger than that of the No. 5 and No. 6 iron, while the No. 9 iron and the pitching wedge (the sand wedge as well) have an equal tip diameter which is larger than that of the No. 7 and No. 8 irons.

In FIG. 5, line A" represents reverse deflection variation for the wood clubs, whereas lines b" indicate reverse deflection variation for the iron clubs. Broken line B" shows that the No. 3, No. 5, No. 7 and No. 9 irons retain proportionality in reverse deflection relative to the wood clubs.

The modification shown in FIG. 5 may be further modified so that each two consecutively numbered irons (the No. 4 and No. 5 irons for example) having different tip diameters differ in first step length $L_1$ only by an amount $\Delta L_1$ which is equal to $\Delta L_0$, whereas each two consecutively numbered irons (the No. 3 and No. 4 irons for example) having an equal tip diameter differ in first step length $L_1$ by an amount $\Delta L_1$ which is larger than $\Delta L_0$. If thus modified, the reverse deflection of all the iron clubs may be made to vary proportionally along the broken line B'.

Figure 6:
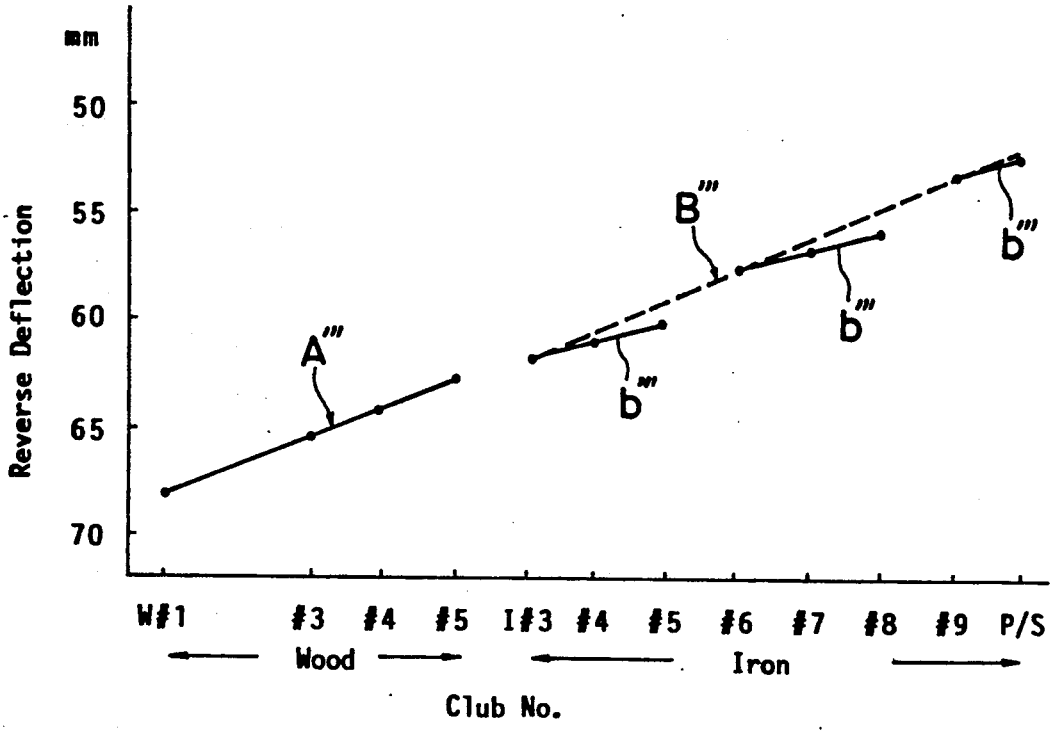
FIG. 6 is a graph showing the reverse deflection characteristics of still another golf club set according to the present invention.

FIG. 6 shows a further modification which is again applicable to a set of golf clubs each having a multiply stepped shaft (FIG. 1). In the modification of FIG. 6, the first step length $L_1$ of the respective iron clubs included in the set is made to decrease progressively by an amount $\Delta L_1$ (larger than $\Delta L_0$) as the iron club number increases by one, whereas the tip diameter Dt of the iron clubs is made to increase progressively as the iron club number increases by three. Specifically, the No. 3 to No. 5 irons have an equal tip diameter Dt, and the No. 6 to No. 8 irons also have an equal tip diameter which is larger than that of the No. 3 to No. 5 irons. Similarly, the No. 9 and the pitching wedge (the sand wedge as well) have an equal tip diameter which is larger than that of the No. 6 to No. 8 irons.

In FIG. 6, line A''' represents reverse deflection variation for the wood clubs, whereas lines b''' indicate reverse deflection variation for the iron clubs. Broken line B''' shows that the No. 3, No. 6 and No. 9 irons retain proportionality in reverse deflection relative to the wood clubs.

The modification shown in FIG. 6 may be further modified so that each two consecutively numbered irons (the No. 5 and No. 6 irons for example) having different tip diameters differ in first step length $L_1$ only by an amount $\Delta L_1$ which is equal to $\Delta L_0$, whereas each three consecutively numbered irons (the No. 3 to No. 5 irons for example) having an equal tip diameter differ in first step length $L_1$ by an amount $\Delta L_1$ which is larger than $\Delta L_0$. If thus modified, the reverse deflection of all the iron clubs may be made to vary proportionally along the broken line B'''.

The present invention being thus described, it is obvious that the same may be varied in many other ways. Such variations are not to be regarded as a departure from the spirit and scope of the invention, and all such modifications as would be obvious to those skilled in the art are intended to be included within the scope of the following claims.

We claim:

1. A golf club set comprising a plurality of differently numbered wood clubs and a plurality of differently numbered iron clubs, each club including a shaft which diametrically increases stepwise from a head end to a grip end, the shaft of said each iron club including a first step at the head end, each shaft having an overall length $L_0$, and each first step having a length $L_1$, the overall length $L_0$ of the iron club shafts decreasing by an amount $\Delta L_0$ as the iron club number increases by one, the length $L_1$ of the respective first steps of the iron club shafts decreasing by an amount $\Delta L_1$ as the iron club number increases by one, and wherein $\Delta L_1$ is set larger than $\Delta L_0$, and wherein $\Delta L_0$ and $\Delta L_1$ are of the same sign.

2. the golf club set according to claim 1, wherein the iron clubs include No. 3 iron whose first step length $L_1$ is 35–40% of the overall shaft length $L_0$ of the No. 3 iron.

3. The golf club set according to claim 1, wherein the iron clubs include No. 3 to No. 9 irons as well as a pitching wedge and a sand wedge, the first step length $L_1$ of the pitching wedge being the same as that of the sand wedge, the first step length $L_1$ of the No. 3 iron being larger than that of the pitching wedge by an amount of $(\Delta L_1-\Delta L_0)\times 7$ (mm), the first step length $L_1$ of the No. 4 iron being larger than that of the pitching wedge by an amount of $(\Delta L_1-\Delta L_0)\times 6$ (mm), the first step length $L_1$ of the No. 5 iron being larger than that of the pitching wedge by an amount of $(\Delta L_1-\Delta L_0)\times 5$ (mm), the first step length $L_1$ of the No. 6 iron being larger than that of the pitching wedge by an amount of $(\Delta L_1-\Delta L_0)\times 4$ (mm), the first step length $L_1$ of the No. 7 iron being larger than that of the pitching wedge by an amount of $(\Delta L_1-\Delta L_0)\times 3$ (mm), the first step length $L_1$ of the No. 8 iron being larger than that of the pitching wedge by an amount of $(\Delta L_1-\Delta L_0)\times 2$ (mm), the first step length $L_1$ of the No. 9 iron being larger than that of the pitching wedge by an amount of $(\Delta L_1-\Delta L_0)\times 1$ (mm).

4. A golf club set comprising a plurality of differently numbered wood clubs and a plurality of differently numbered iron clubs, each club including a shaft which has a tip diameter at a head end thereof, the respective shafts of the wood clubs having a substantially equal tip diameter, the tip diameter of a lowest numbered iron club being generally equal to that of each wood club, the tip diameter of the respective iron clubs progressively increasing as the iron club number increases by one.

5. The golf club set according to claim 4, wherein the tip diameter of the lowest numbered iron club is generally equal to that of said each wood club within a deviation range of 0 mm to +0.2 mm.

6. A golf club set comprising a plurality of differently numbered wood clubs and a plurality of differently numbered iron clubs, each club including a shaft which has a tip diameter at a head end thereof, the respective shafts of the wood clubs having a substantially equal tip diameter, the tip diameter of a lowest numbered iron club being generally equal to that of each wood club, the tip diameter of the respective iron clubs progressively increasing as the iron club number increases by two.

7. The golf club set according to claim 6, wherein the tip diameter of the lowest numbered iron club is generally equal to that of said each wood club within a deviation range of 0 mm to +0.2 mm.

8. A golf club set comprising a plurality of differently numbered wood clubs and a plurality of differently numbered iron clubs, each club including a shaft which has a tip diameter at a head end thereof, the respective shafts of the wood clubs having a substantially equal tip diameter, the tip diameter of a lowest numbered iron club being generally equal to that of each wood club, the tip diameter of the respective iron clubs progressively increasing as the iron club number increases by three.

9. The golf club set according to claim 8, wherein the tip diameter of the lowest numbered iron club is generally equal to that of said each wood club within a deviation range of 0 mm to +0.2 mm.

* * * * *